US007963234B2

(12) United States Patent
Korolainen

(10) Patent No.: US 7,963,234 B2
(45) Date of Patent: Jun. 21, 2011

(54) COMPUTER TABLE ELEMENT

(75) Inventor: Jussi Korolainen, Helsinki (FI)

(73) Assignee: Hidesk Oy (FI)

( * ) Notice: Subject to any disclaimer, the term of this patent is extended or adjusted under 35 U.S.C. 154(b) by 725 days.

(21) Appl. No.: 10/582,265

(22) PCT Filed: Dec. 8, 2004

(86) PCT No.: PCT/FI2004/050182
§ 371 (c)(1),
(2), (4) Date: Jul. 10, 2008

(87) PCT Pub. No.: WO2005/055764
PCT Pub. Date: Jun. 23, 2005

(65) Prior Publication Data

US 2008/0290766 A1 Nov. 27, 2008

(30) Foreign Application Priority Data

Dec. 12, 2003 (FI) ..... 20035234

(51) Int. Cl.
*A47B 37/00* (2006.01)
*A47B 81/00* (2006.01)
*A47B 97/00* (2006.01)

(52) U.S. Cl. ..... 108/50.01; 312/223.3; 312/194

(58) Field of Classification Search ..... 108/50.01, 108/50.02, 143, 125; 312/223, 3, 194, 195, 312/208.1
See application file for complete search history.

(56) References Cited

U.S. PATENT DOCUMENTS 4,669,789 A * 6/1987 Pemberton ..... 312/223.3
5,071,204 A 12/1991 Price et al.
5,199,773 A * 4/1993 Price et al. ..... 312/7.2
5,368,377 A 11/1994 Baines
5,377,951 A * 1/1995 Johnson et al. ..... 248/639
5,544,594 A * 8/1996 Schairbaum ..... 108/50.01
5,694,861 A * 12/1997 Laukamm-Josten ..... 108/50.01
5,765,797 A * 6/1998 Greene et al. ..... 248/398
6,012,694 A * 1/2000 Sullivan, III ..... 248/323
6,016,755 A * 1/2000 Trapani ..... 108/50.01
6,092,883 A 7/2000 Lechman
(Continued)

FOREIGN PATENT DOCUMENTS

DE 196 51 488 A1 6/1998
(Continued)

OTHER PUBLICATIONS

International Search Report for parent application PCT/FI2004/050182, having a mailing date of Apr. 14, 2005.
Finnish Search Report for corresponding Finnish application, dated Jun. 16, 2004.

*Primary Examiner* — Darnell M Jayne
*Assistant Examiner* — Timothy M Ayres
(74) *Attorney, Agent, or Firm* — Andrus, Sceales, Starke & Sawall, LLP

(57) ABSTRACT

The invention relates to a computer table element (1), comprising a body (2), a sliding keyboard panel (3) having an extended working position and a retracted storage position, a bearer (9, 10) mounted pivotably on the body (2) for supporting a flat-panel display (11) in various positions, and a front wall (6) beneath the keyboard panel (3). The keyboard panel (3) has its movement transmitted by a pivot joint (4) to the front wall (6) and by swing arms (5*a*, 5*b*) to the display bearer (9, 10), such that the front wall (6) and the bearer (9, 10) swivel towards a vertical plane as the keyboard panel (3) travels from the working position to the storage position. This results in more leg room under the table.

15 Claims, 3 Drawing Sheets

U.S. PATENT DOCUMENTS

| | | | | |
|---|---|---|---|---|
| 6,431,377 | B1 * | 8/2002 | Lechman | 211/133.2 |
| 6,527,235 | B1 * | 3/2003 | Cotterill | 248/118.3 |
| 7,047,890 | B2 * | 5/2006 | Korber et al. | 108/50.01 |
| 2002/0053862 | A1 * | 5/2002 | Visser et al. | 312/223.3 |

FOREIGN PATENT DOCUMENTS

| | | | |
|---|---|---|---|
| DE | 101 59 378 | C1 | 10/2002 |
| FI | 77967 | B | 2/1989 |
| FI | 990192 | U | 8/1999 |

* cited by examiner

COMPUTER TABLE ELEMENT

CROSS-REFERENCE TO RELATED APPLICATIONS

This application is the U.S. national stage application of International Application PCT/FI2004/050182, filed Dec. 8, 2004, which International Application was published on Jun. 23, 2005, as International Publication No. WO 2005/055764 A1 in the English language. The International Application claims priority of Finnish Patent Application 20035234, filed Dec. 12, 2003.

FIELD OF THE INVENTION

The present invention relates to a computer table element, comprising a body, a sliding keyboard panel having an extended working position and a retracted storage position, a bearer mounted pivotably on the body for supporting a flat-panel display in various positions, means for transmitting a movement of the keyboard panel to the bearer.

BACKGROUND OF THE INVENTION

This type of computer table elements are previously known for example from patent publication U.S. Pat. No. 5,071,204, wherein the element has its body attached by its sides to side walls which define a working space (for operator's legs). The body has its bottom portion fitted with bracing walls, which are formed with slots that are in turn adapted to have a display bearer mounted thereon by means of studs fitting in the slots. There are several slots in the bracing walls, whereby the bearer and the display can be secured at a desired height and at a desired angle. The keyboard panel comprises a separate panel extensible from below the tabletop.

Adjustment of such an element is difficult. In addition, the bearer may also get in the way of a person's legs in the working space unless the table is designed for a sufficient size in terms of its depth. Hence, this results in limitations regarding the dimension of a table in terms of its depth, i.e. the table cannot necessarily be made sufficiently small in terms of its depth.

SUMMARY OF THE INVENTION

It is an object of the present invention to eliminate or substantially alleviate the above drawbacks.

In order to accomplish the above abject of the invention, the present invention is characterized in that the means include a swing arm, which is connected by a first pivot joint to the bearer's bottom portion and the turning of which makes the display bearer pivotable for reducing an angle between the display and a vertical plane, i.e. the display swivels towards the vertical plane as the keyboard panel travels from the working position to the storage position, and that the computer table element includes a front cover mounted removably or permanently on the swing arm, and that the front cover is adapted to swivel together with the swing arm.

BRIEF DESCRIPTION OF THE DRAWINGS

The invention will now be described in more detail with reference to the accompanying drawings, in which.

DETAILED DESCRIPTION OF THE DRAWINGS

Figure 1:
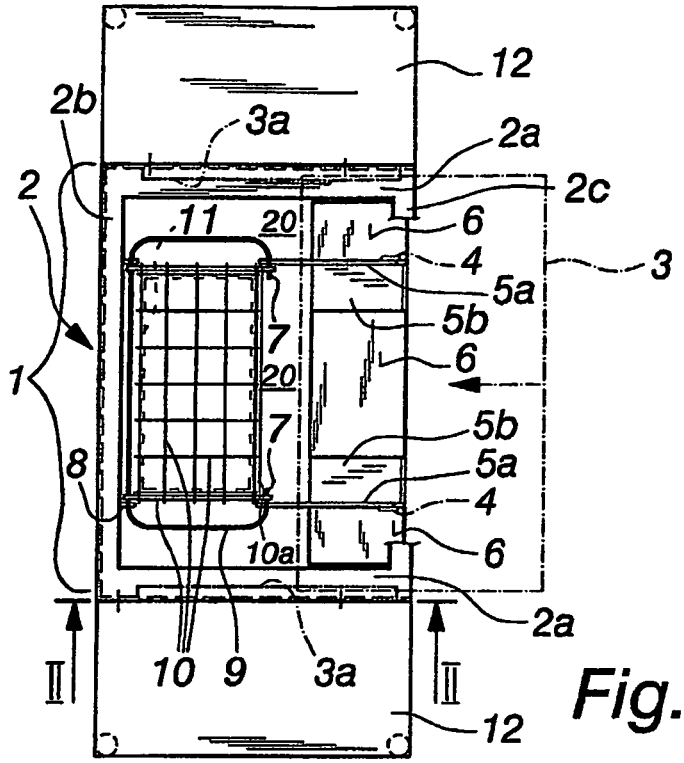
FIG. 1 shows a schematic plan view of a computer table element in a working position.
Figure 2:
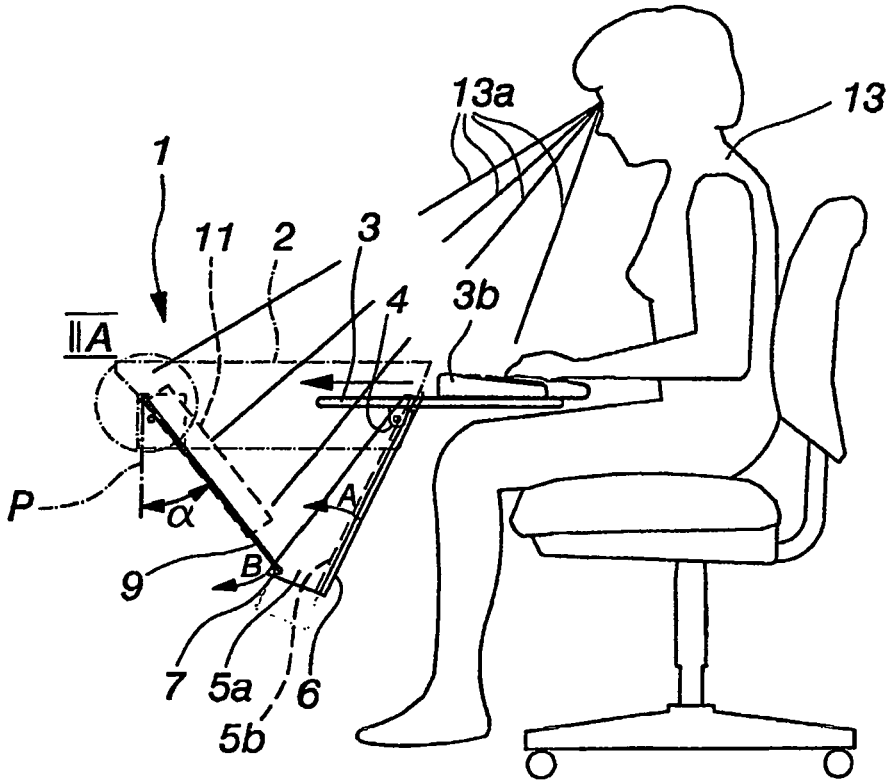
FIG. 2 shows a computer table element in a working position in a section along a line II-II in FIG. 1.

Thus, FIGS. 1 and 2 illustrate in a plan view and in a side view, respectively, a computer table element, designated with reference numeral 1, in a working position. The element 1 comprises a body 2. The body 2 is folded for example from sheet metal for providing a rectangular frame. It has two sets of elongated side members 2*a*, connected at one of the ends thereof by an elongated cross member 2*b* which constitutes a rear portion of the body. The width of the element is defined by the length of the cross member. The body has its front portion provided with a cross member 2*c*, which is limited to the plane of the element's top surface and which is depicted in a cut-away view for visualising the components below. The body 2 can be attached by its side members 2*a* to side walls defining a working space 20 (leg room). On top of the upper lips of the side members 2*a* and the cross members 2*b*, 2*c* can be fitted for example a glass panel (not shown), which forms a table top and constitutes a worktop having a width substantially equal to that of the element 1. In order to provide extensions to the lateral edges of the glass panel, it is possible to attach laterally extending additional panels 12 on the same vertical level.

In association with the body 2 is provided a keyboard panel 3 movable in the depth direction of the worktop. It is adapted to travel between the side members 2*a*, preferably by means of roller or slide tracks 3*a* fastened to the side members 2*a*. The tracks 3*a* are located in the proximity of the worktop below the worktop. Indicated by a dash-and-dot line in FIG. 1 is a keyboard panel 3, which is partly extended from below the worktop to its working position. In the working position, at least a computer keyboard 3*b* set on top of the panel 3 is exposed for an operator 13 illustrated in FIG. 2.

Figure 2A:
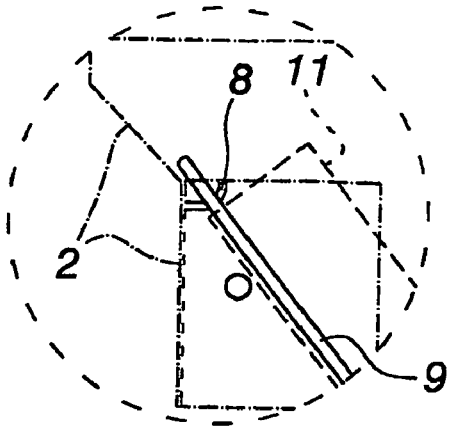
FIG. 2A shows a partial enlargement of a detail IIA in FIG. 2.

According to the present invention, in association with the body 2 is provided a bearer 9, 10 for supporting a flat-panel display 11 in various positions in the working space 20. In a working position, the bearer 9, 10 of the display 11 is at such an angle relative to the operator 13 that the display 11 falls effortlessly within a visual field 13*a* of the operator 13. The bearer comprises a circular frame member 9 of bent metal bar, defining a planar zone within which is fitted a suspension member 10 having e.g. a mesh-like structure. The flat-panel display 11 can be supported from the suspension member 10. For this purpose, the suspension member 10 is provided with a separate clamping element 10*a* or strap for securing the display 11 in place. It is visualised in FIG. 2A that the actual frame member 9, which thus carries the display 11 along with itself, is adapted to hang by its elongated top portion codirectional with the crossbar 2*b* through the intermediary of coupling elements 8 provided in the crossbar 2*b* in engagement with the crossbar 2*b*. Consequently, the frame member 9 has a top portion which constitutes an elongated swivel axle about which the remainder of the frame member 9 is capable of rotating as supported by the coupling elements 8. The frame member 9 and the suspension member 10 may be subjected to a multitude of modifications in structural sense.

In the present case, the frame member 9 has its bottom portion consisting of two hook-shaped engagement elements 7 spaced from each other. A single engagement element 7 constitutes a pivot axle or joint, which is parallel to a swivel axle constituted by the top portion of the frame member 9. In addition to this, on substantially the same laterally extending level with the engagement elements 7, there are provided fastening lugs 4 extending downwards from the bottom surface of the keyboard panel 3. These are provided with joints, having pivot axes which are parallel to the swivel axle constituted by the top portion of the frame member 9. In horizontal direction, these axes extend in a lateral sense of the table.

A single joint 7, as well as a joint in alignment therewith in a lateral sense and provided in the fastening lug 4, are provided with a pivotably mounted elongated swing arm 5*a*, 5*b*, which are spaced from each other in a sideways or lateral direction of the element. Thus, the element 1 here includes two swing arms 5*a*, 5*b*. In its cross-section the swing arm 5*a*, 5*b* is preferably substantially in the shape of the letter L and it is bent from a preferably plate-like piece to a 90-degree angle. Hence, it comprises a strip-like vertical lip 5*a*, as well as a strip-like face lip 5*b* disposed at an angle relative thereto. The swing arm 5*a*, 5*b* is connected at the vertical lip's 5*a* bottom end to the joint 7 and at the vertical lip's 5*a* top end to the fastening lug 4. On the other hand, the face lips 5*b* provide engagement surfaces essentially towards the operator 13 for removably attaching a front wall 6 thereto. The front wall 6 connects the two spaced-apart swing arms 5*a*, 5*b* to each other. The front wall 6 conceals and protects the element's 1 above-described components housed in the working space 20, and the display 11. The front wall 6 or the kickplate can also be permanently attached to the swing arms 5*a*, 5*b*. Alternatively, the front panel 6 may also function as a part of the swing arm, which in this case consists of a front panel 6 and articulation lugs secured thereto. Between the front panel's 6 bottom end and the joint 7 must be provided a sufficient distance in order to prevent the front panel 6 from colliding with the display 11 in a storage position. In the present case, this is accomplished by designing the vertical lip's 5*a* bottom end with a sufficient width.

Figure 3:
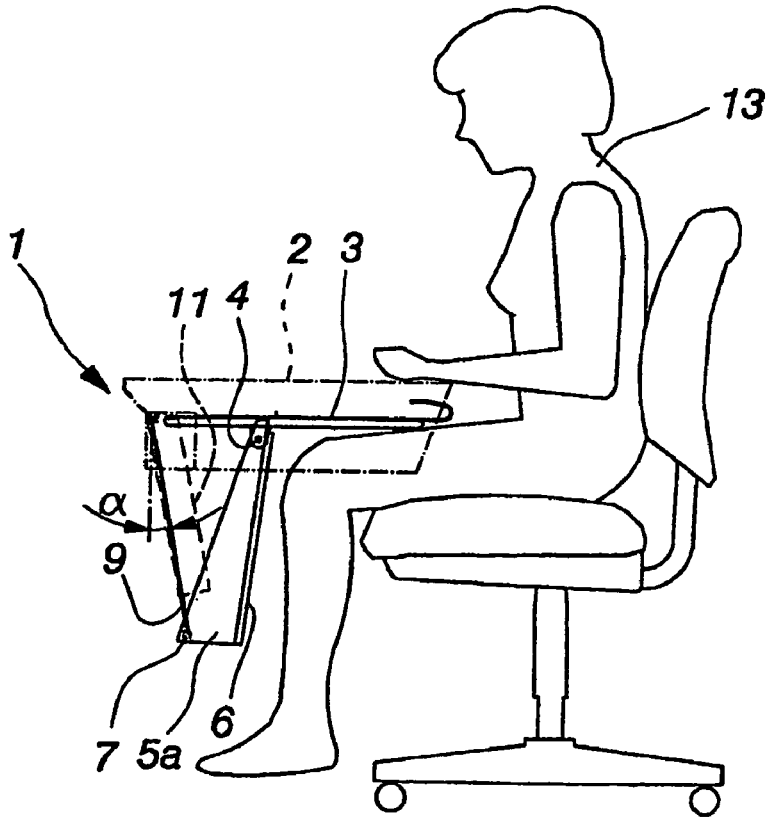
FIG. 3 shows a schematic side view of a computer table element in a storage position.

In the process of moving the keyboard panel 3 from the working position shown in FIGS. 1 and 2 to the storage position shown in FIG. 3, the swing arms 5*a*, 5*b* and thereby the front wall 6 swivel to a more vertical position, as indicated by an arrow A. At the same time, the freely movable attachment joints 7 move deeper into the leg space, as indicated by an arrow B. Thus, the suspension element's frame member 9 swivels to a more vertical position for reducing an angle $\alpha$ between the frame member 9 (display 11) and a vertical plane P extending through a pivot axis established by its upper body. This feature increases the working space 20, especially when the operator 13 needs it for his/her legs while sitting, as shown in FIG. 3, in a closer proximity to the element 1, in other words when using the element 1 as a desk.

Figure 4A:
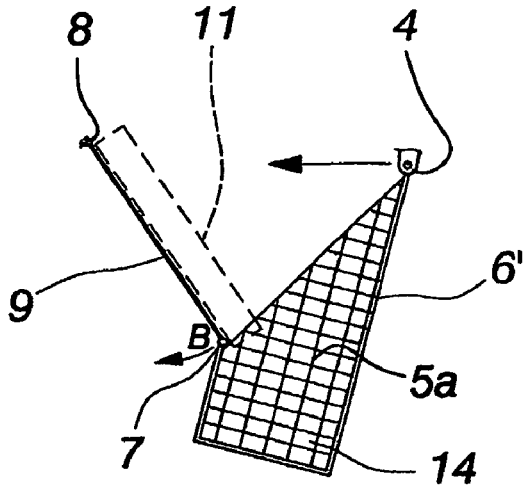
FIG. 4A shows a side view of a computer table element (not showing a keyboard panel) of another embodiment in a working position.
Figure 4B:
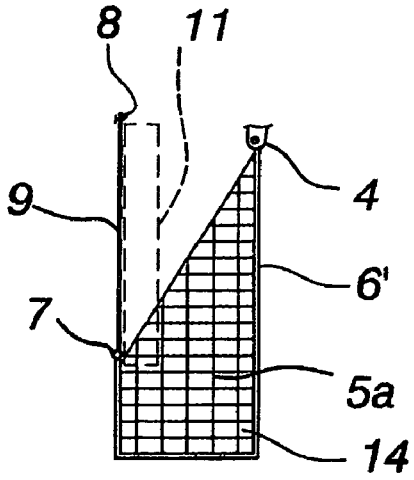
FIG. 4B shows the computer table element of FIG. 4A in a storage position.

FIGS. 4A and 4B illustrate an optional embodiment for the structure of a swing arm and a front cover, which in this instance are preferably manufactured from a wire mesh. The wire mesh or some other rigid material has been used for reticulated vertical lips 5*a* for the swing arm and a reticulated front cover 6' left therebetween. The reticulated structure has its bottom portion, which is left below the joint 7, designed as a cord basket 14 for placing cords and the like therein. The front cover 6', the swing arms 5*a*, and the cord basket 14 are made by bending from a single-piece mesh structure.

The invention claimed is:

1. A computer table element, comprising a body, a sliding keyboard panel having an extended working position and a retracted storage position, a bearer mounted pivotably on the body for supporting a flat-panel display in various positions, and means for transmitting a movement of the keyboard panel to the bearer, wherein the means include at least one swing arm, which is connected by a first pivot joint to a bottom portion of the bearer, wherein turning of the first pivot joint makes the bearer pivot for reduction of an angle between the display and a vertical plane as the keyboard panel travels from the working position to the storage position, wherein the swing arm is connected to the bottom portion of the bearer and wherein the computer table element comprises a front cover mounted removably or permanently on the swing arm, and wherein the front cover is adapted to swivel together with the swing arm thereby protecting the display, and wherein in the storage position the display is oriented substantially vertical and below a horizontal plane defined by the keyboard panel.

2. An element as set forth in claim 1, wherein the at least one swing arm comprises two swing arms, each having an L-shaped cross-section and being connected by a second pivot joint to the keyboard panel.

3. An element as set forth in claim 1, wherein the front cover comprises a wire mesh.

4. An element as set forth in claim 1, wherein the bearer comprises a frame member and a suspension member supported thereon.

5. An element as set forth in claim 1, wherein the at least one swing arm comprises two swing arms of L-shaped cross-section, which are connected by a pivot joint to the keyboard panel.

6. An element as set forth in claim 4, wherein the second pivot joint comprises a horizontal swivel axle.

7. An element as set forth in claim 6, comprising a third pivot joint located at a top of the frame member.

8. An element as set forth in claim 7, wherein the third pivot joint comprises a horizontal swivel axle.

9. A computer table element, comprising a body, a sliding keyboard panel having an extended working position and a retracted storage position, a bearer mounted pivotably on the body for supporting a flat-panel display in various positions, wherein the computer table element comprises a front cover beneath the keyboard panel, wherein the front cover and the display bearer have bottom portions thereof linked to each other by a horizontal first pivot joint and wherein movement of the keyboard panel is transmitted by a second pivot joint to the front cover for reduction of an angle between the front cover and a vertical plane as the keyboard panel travels from the working position to the storage position thereby protecting the display, and wherein in the storage position the display is oriented substantially vertical and below a horizontal plane defined by the keyboard panel.

10. An element as set forth in claim 9, wherein a top portion of the display bearer is connected to the body by a horizontal swivel axle, whereby, while swiveling towards the vertical plane, the front cover moves in its entirety towards a rear portion of the element as the display bearer swivels towards the vertical plane.

11. An element as set forth in claim 9, wherein the front cover comprises a wire mesh.

12. An element as set forth in claim 10, wherein the front cover comprises a wire mesh.

13. An element as set forth in claim 9, wherein the bearer comprises a frame member and a suspension member supported thereon.

14. An element as set forth in claim 13, comprising a third pivot joint located at a top of the frame member.

15. An element as set forth in claim 14, wherein the third pivot joint comprises a horizontal swivel axle.

* * * * *